US006708453B1

(12) United States Patent
Hurst et al.

(10) Patent No.: US 6,708,453 B1
(45) Date of Patent: Mar. 23, 2004

(54) GUTTER PROTECTION SYSTEM

(75) Inventors: Larry Hurst, Peachtree City, GA (US); Tony Ray Waldrop, Peachtree City, GA (US)

(73) Assignee: Larry Timothy Hurst, Peachtree City, GA (US)

( * ) Notice: Subject to any disclaimer, the term of this patent is extended or adjusted under 35 U.S.C. 154(b) by 0 days.

(21) Appl. No.: 10/410,329

(22) Filed: Apr. 9, 2003

(51) Int. Cl.[7] ..... E04D 13/04
(52) U.S. Cl. ..... 52/12; 248/48.2
(58) Field of Search ..... 52/11, 12, 13, 52/14; 248/48.1, 48.2; 210/474, 473

(56) References Cited

U.S. PATENT DOCUMENTS

| | | | | | |
|---|---|---|---|---|---|
| 2,672,832 | A | | 3/1954 | Goetz | |
| 4,404,775 | A | | 9/1983 | Demartini | |
| 4,435,925 | A | | 3/1984 | Jefferys | |
| 4,796,390 | A | | 1/1989 | Demartini | |
| 4,937,986 | A | * | 7/1990 | Way et al. | 52/12 |
| 5,016,404 | A | | 5/1991 | Briggs | |
| 5,216,851 | A | | 6/1993 | Kuhns | |
| 5,457,916 | A | | 10/1995 | Tenute | |
| 5,495,694 | A | * | 3/1996 | Kuhns | 52/12 |
| 5,640,809 | A | * | 6/1997 | Iannelli | 52/12 |
| 5,660,001 | A | * | 8/1997 | Albracht | 52/12 |
| 5,813,173 | A | * | 9/1998 | Way, Sr. | 52/12 |
| 5,819,476 | A | * | 10/1998 | Annestedt, Sr. | 52/11 |
| 6,016,631 | A | * | 1/2000 | Lowrie, III | 52/12 |
| 6,269,592 | B1 | * | 8/2001 | Rutter | 52/12 |
| 6,367,743 | B1 | * | 4/2002 | Iannelli | 248/48.2 |
| 6,412,228 | B1 | * | 7/2002 | Meckstroth | 52/12 |

* cited by examiner

*Primary Examiner*—Leslie A. Braun
*Assistant Examiner*—Tan Le
(74) *Attorney, Agent, or Firm*—Gardner Groff, P.C.

(57) ABSTRACT

The present invention provides various embodiments of a gutter cap and a locking system that couples the gutter cap to the gutter. Because the gutter cap is not directly fastened to the gutter by the locking system, as is the case with many prior art designs, the cap is allowed to move slightly with respect to the gutter, and vice versa. This feature of the present invention reduces the likelihood that movement of the gutter will result in damage to the gutter cap, and vice versa. In accordance with the present invention, the coupling of the cap to the gutter is accomplished by using one or more clips that are configured to secure the cap to the gutter at one or more locations in a way that allows the gutter and the cap to move independently of one another. Furthermore, because the gutter cap of the present invention is not directly fastened to the hem edge of the gutter, as is the case with most prior art gutter caps, more water flows off of the cap into the gutter than with prior art systems that have the cap fastened directly to the hem edge of the gutter. In addition, the end of the cap preferably comprises angled breaks that cause the water to adhere to the cap end as it flows about the cap end before it falls into the gutter trough. The result is that the amount of water that flows off of the cap without entering the gutter trough is lessened in comparison to existing gutter cap designs.

4 Claims, 6 Drawing Sheets

GUTTER PROTECTION SYSTEM

TECHNICAL FIELD OF THE INVENTION

The present invention relates to gutter systems used to collect rain water and, more particularly, to a gutter cap that directs water into the gutter while preventing debris from entering the gutter.

BACKGROUND OF THE INVENTION

A typical gutter system is mounted just below the edge of a roof of a house or building and is used to collect rain water and direct the rain water away from the house or building. The gutters are normally mounted generally parallel to the ground so that the collected water flows through the gutters in a direction generally parallel to the ground until the flowing water reaches down spouts, which are generally parallel to the gutters. The water flows into the down spouts, which direct the water downward and ultimately in a direction away from the house or building.

As water flows into the gutters, debris such as leaves, sticks and pine straw, for example, is often carried by the water flow into the gutters. Wind and rain can also cause debris to fall directly into the gutters from, for example, trees that extend above the roof. Such debris can clog the gutters and down spouts and thus prevent the gutter system from performing its intended purpose of directing water away from the house or building. This can damage the gutter system and/or the house or building.

To prevent debris and other material or items from clogging gutters and/or down spouts of gutter systems, gutter caps have been developed that at least partially cover the gutters and prevent debris from entering the gutter system, or at least lessen the amount of debris that falls into the gutters to the extent that the aforementioned clogging problems are prevented. Examples of devices that are designed for this purpose are disclosed in, for example, U.S. Pat. Nos. 2,672,832, 4,404,775, 4,435,925, 4,796,390, 5,016,404, 5,216,851 and 5,457,916.

Existing gutter shielding devices (hereinafter referred to as "gutter caps") have various disadvantages. One major disadvantage is that existing gutter caps, such as that shown in U.S. Pat. No. 5,457,916, for example, attach directly to the gutter, which means that if the gutter bends or is deformed or damaged in some way (e.g., as a result of the force of rain and/or wind), the cap will likely also be deformed or damaged. Also, such caps typically attach to the front lip of the gutter and the aesthetic nature of the gutter system can be compromised due to scratches on the gutters and/or the gutter caps that occur when the caps are being attached (e.g., by screws) to the gutters.

Existing gutter caps that attach directly to the gutters often have slot openings formed at particular locations in them that are intended to allow water to flow through the cap into the gutter while blocking debris so that the debris doesn't enter the gutter and clog up the gutter and impede the flow of water through the gutter. One of the problems associated with caps that have slot openings formed in them for this purpose is that debris can get caught in these openings and block them, thereby preventing water from flowing into the gutter, or limiting the amount of water that is allowed to enter the gutter.

Another problem associated with some existing gutter caps is that they are designed and manufactured only to work with one particular gutter system. In this case, if the consumer wants a gutter cap, the consumer has no choice but to use the gutter cap that is designed specifically for use with the particular gutter system. Therefore, existing gutters cannot be retrofitted with these gutter caps if the gutters are of a type other than the particular type for which the cap is designed.

Another problem associated with some existing gutter caps is that they are single-piece caps. If the cap is damaged in one or more locations, the entire cap, as opposed to a portion of the cap, must be replaced in order to repair the gutter system. Of course replacing the entire cap can be expensive, and typically would be more expensive than replacing a five or six-foot gutter cap section.

A need exists for a gutter cap that is capable of maintaining its design even when a deformity to the gutter to which the cap is coupled exists or occurs, that can be easily installed without affecting the aesthetic appearance of the gutter, that maximizes the amount of water that enters the gutter system and that prevents debris from entering the gutter system, or at least minimizes the likelihood that debris will impede the flow of water in the gutter system.

SUMMARY OF THE INVENTION

The present invention provides various embodiments of a gutter cap and a locking system that couples the gutter cap to the gutter. Because the gutter cap is not directly fastened to the gutter by the locking system, as is the case with many prior art designs, the cap is allowed to move slightly with respect to the gutter, and vice versa. This feature of the present invention reduces the likelihood that movement of the gutter will result in damage to the gutter cap, and vice versa. In accordance with the present invention, the coupling of the cap to the gutter is accomplished by using one or more clips that are configured to secure the cap to the gutter at one or more locations in a way that allows the gutter and the cap to move independently of one another. Furthermore, because the gutter cap of the present invention is not directly fastened to the hem edge of the gutter, as is the case with most prior art gutter caps, more water flows off of the cap into the gutter than with prior art systems that have the cap fastened directly to the hem edge of the gutter. In addition, the end of the cap preferably comprises angled breaks that cause the water to adhere to the cap end as it flows about the cap end before it falls into the gutter trough. The result is that the amount of water that flows off of the cap without entering the gutter trough is lessened in comparison to existing gutter cap designs.

These and other features and advantages of the present invention will become apparent from the following description, drawings and claims.

DETAILED DESCRIPTION OF THE PREFERRED EMBODIMENT

The present invention provides various embodiments of a gutter cap and a locking system that couples the gutter cap to the gutter. Because the gutter cap is not directly fastened to the gutter, as is the case with many prior art designs, the cap is allowed to move slightly with respect to the gutter, and vice versa. This feature of the present invention reduces the likelihood that movement of the gutter will result in damage to the gutter cap, and vice versa. In accordance with the present invention, the coupling of the cap to the gutter is accomplished by using one or more clips that are configured to secure the cap to the gutter at one or more locations in a way that allows the gutter and the cap to move independently of one another. Furthermore, because the gutter cap of the present invention is not directly fastened to the hem edge of the gutter, as is the case with most prior art gutter caps, more water flows off of the cap into the gutter than with prior art systems that have the cap fastened directly to the hem edge of the gutter. With those prior art systems, openings typically are formed in the gutter cap to allow water to flow from the cap into the gutter. Those openings tend to become clogged at times by pine straw or other debris that flows off of the cap, which reduces the amount of water that flows from the cap into the gutter and can result in water damage to the house or building. In addition, the end of the cap preferably comprises angled breaks that cause the water to adhere to the cap end as it flows about the cap end before it falls into the gutter trough. The result is that the amount of water that flows off of the cap without entering the gutter trough is lessened in comparison to existing gutter cap designs.

Figure 1A:
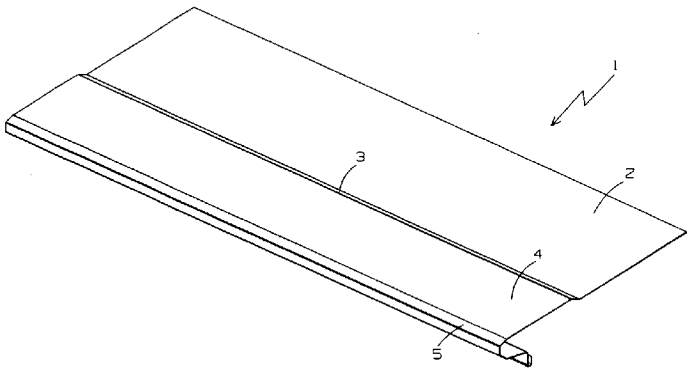
FIG. 1A is a perspective view of the gutter cap of the present invention in accordance with a first example embodiment.
Figure 1B:
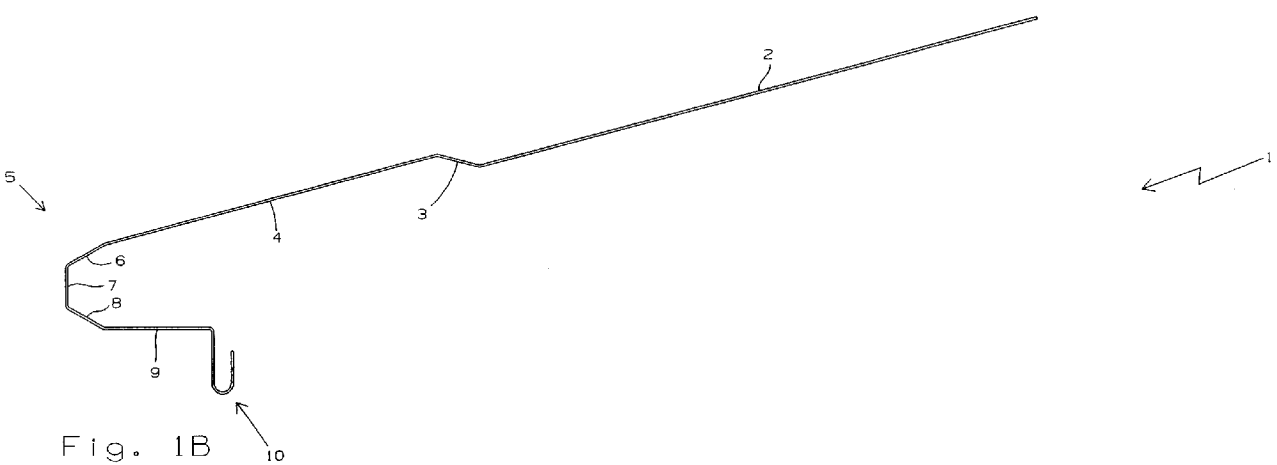
FIG. 1B is a side view of the gutter cap of the present invention in accordance with a first example embodiment.

FIG. 1A is a perspective view of the gutter cap 1 of the present invention in accordance with a first example embodiment. FIG. 1B is a side view of the gutter cap of the present invention in accordance with a first example embodiment. In accordance with the present invention, the gutter cap 1 has a first portion 2, a reverse break 3 and a second portion 4. The reverse break 3 slows the water flow, flattens the water into a thin sheet-like flow, and quickly spread's the water over the second portion 4. The reverse break 3 also breaks up debris, such as soaked leaves, for example. As shown in FIG. 1B, the second portion 2 has an end 5 that has multiple angled breaks 6, 7 and 8, and a terminating end portion 9. In accordance with the present invention, it has been determined that providing these angled breaks 6, 7 and 8 on the end 5 causes water to adhere to the end 5 as it flows around the end 5 toward the terminating end portion 9. In accordance with the present invention, it has been determined that the water adheres better to these angled breaks than to cap ends that are simply rounded. Although it appears to be horizontal in FIG. 3B, the terminating end portion 9 preferably is slightly angled so that it is not parallel to the ground when the cap 2 is in its installed position.

The combination of these breaks 6, 7 and 8, in conjunction with the slightly angled terminating end portion 9, results in better adherence of the water to the cap 1 until the water is over the trough of the gutter (not shown), at which point gravity causes the water to fall into the trough of the gutter. The typical prior art designs utilize a rounded cap ends, although some have ends that are not smoothly rounded. However, even with the prior art designs that do not have smoothly rounded cap ends, the terminating end portion on those caps is parallel to the ground when the caps are installed, and the water does not adhere well to these horizontal terminating end portions. With these prior art designs, water often falls from the cap end toward the ground before the water has a chance to flow into the gutter, especially in conditions of heavy rain.

Figure 2A:
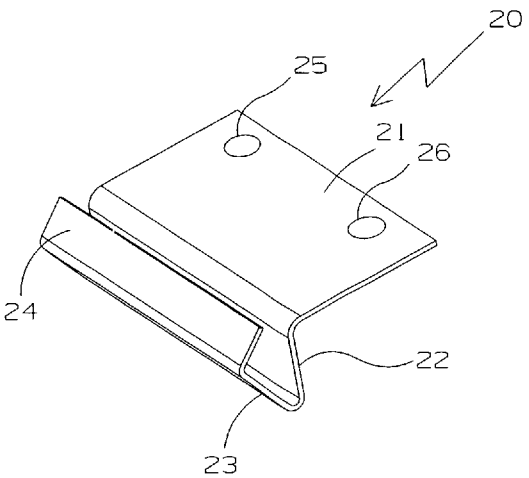
FIG. 2A is a perspective view of a clip that is configured to couple a gutter cap, such as the gutter cap shown in FIG. 1A, for example, in such a way that a limited amount of movement of the cap and the gutter relative to one another is allowed.
Figure 2B:
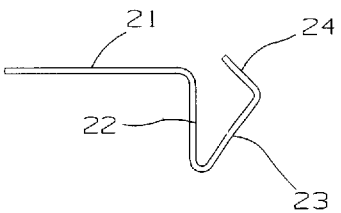
FIG. 2B is a side view of the clip shown in FIG. 2A.
Figure 5:
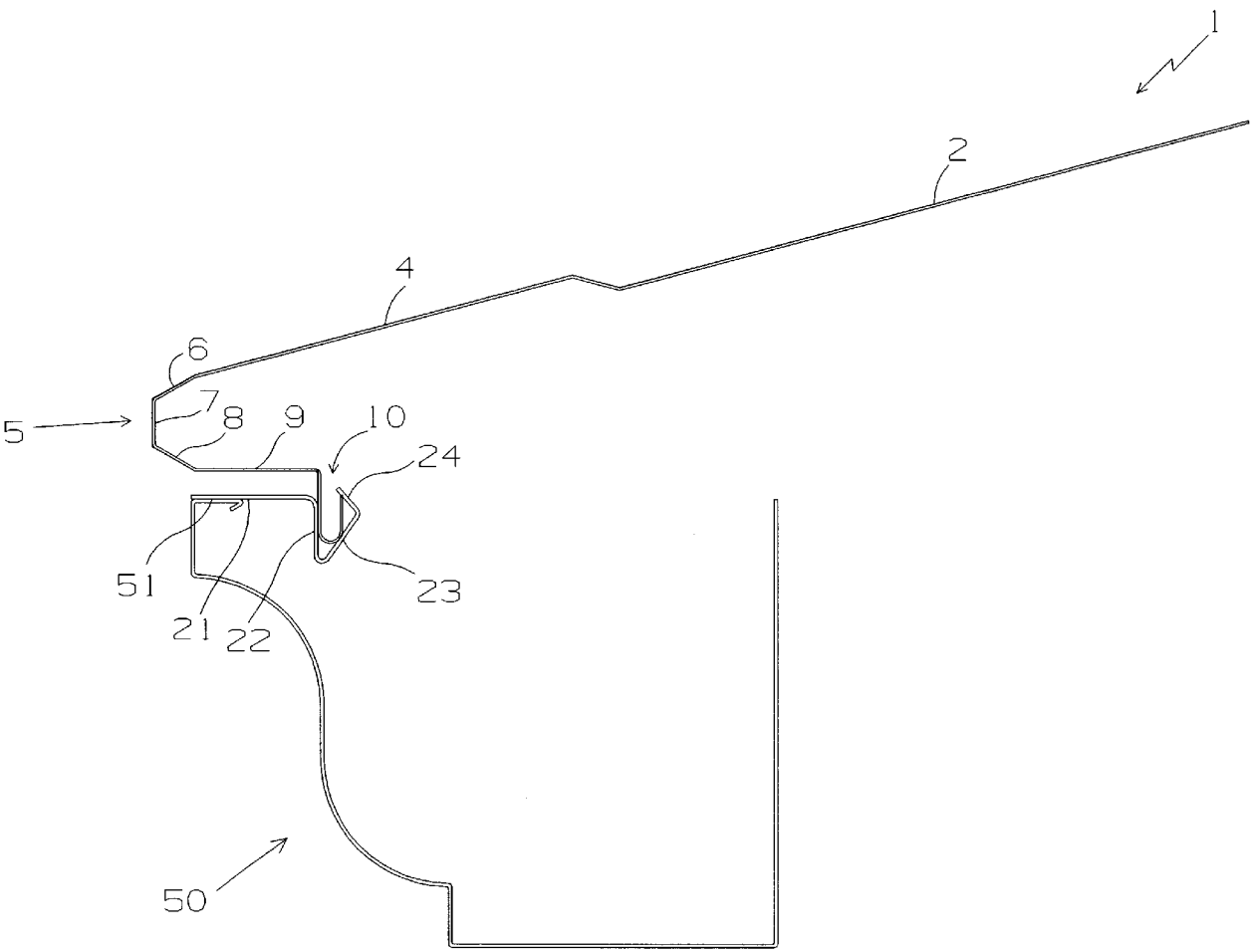
FIG. 5 is a side view of the gutter cap shown in FIGS. 1A and 1B coupled to a gutter by one or more of the clips shown in FIGS. 2A and 2B.

With reference again to FIG. 1B, the gutter cap 1 also has a bottom rib portion 10 that is U-shaped, as shown. This bottom rib portion 10, or hem edge, of the cap 1 provides the cap 1 with addition strength and resistance to downward forces on the cap 1. The rib portion 10 is also the portion of the cap 1 to which the clips of the present invention are secured when the cap 1 is installed, as discussed below with reference to FIG. 5. FIGS. 2A and 2B are perspective and side views, respectively, of an example embodiment of the clip used to attach the cap 1 to a gutter. FIG. 5 illustrates a side view of the gutter cap 1 attached to the hem edge 51 of a gutter 50 by one or more clips of the type shown in FIGS. 2A and 2B, which couple the hem edge 51 of the gutter to the rib portions 10 of the cap 1. The clip 20 shown in FIGS. 2A and 2B has a particular shape that enables it to couple to the rib portion 10 (FIG. 1B) of the cap 1 in such a way that the gutter 50 and the gutter cap 1 have some slight freedom of movement with respect to one another, as described below in more detail.

FIGS. 1B and 2B show particular dimensions and angles. It should be noted that although these particular dimensions and angles are preferred, the present invention is not limited to these dimensions and angles, nor is it limited to the number of breaks formed in the end 5. The present invention also is not limited to any particular shape for the clip used to couple the rib portion of the cap to the hem edge of the gutter.

With reference again to FIG. 2A, the clip 20 in accordance with this example embodiment comprises a first portion 21, a second portion 22, a third portion 23 and a fourth portion 24. The clip 20 preferably also has openings 25 and 26 formed therein that are designed to enable the clip 20 to be easily screwed to the gutter hem edge 51 (FIG. 5). As shown in FIG. 2B, the first portion 21 of the clip 20 is flat and is generally parallel to the ground when the gutter cap 1 is installed and coupled to the gutter 50, as shown in FIG. 5. The second portion 22 of the clip 20 is generally perpendicular to the first portion 21. The third portion 23 is at an angle to the second portion 22 and is directed generally away from the second portion 22. This particular angle is shown to be a 35° angle in FIG. 2B. The fourth portion 24 is at an angle to the third portion 23 and is directed generally back toward the first portion 21, but at an angle to it, as shown. As indicated above, the angles and the dimensions shown are not required, but merely represent an example of one possible implementation that has been found to work well for its intended purpose.

The side view shown in FIG. 5 illustrates the manner in which the clip 20 shown in FIGS. 2A and 2B couples the gutter cap 1 to the hem edge 51 of the gutter 50. The hem edge 51 of the gutter 50 is screwed to the clip 20 by screws (not shown) that pass through openings 25 and 26 (FIG. 2A), or by some other attachment mechanism. Those skilled in the art will understand that a variety of attachment mechanisms are suitable for this purpose. It can be seen in FIG. 5 that the clip portions 22, 23 and 24 grip the rib portion 10 (FIG. 1B) of the cap 1 in a particular manner. This coupling arrangement allows some slight degree of relative movement between the gutter 50 and the cap 1, which provides the aforementioned advantages. The cap 1 may be in 5 or 6-foot sections, for example, and the two clips may be located equidistance away from each other near opposite ends of the gutter cap section. Therefore, the only locations along the section length of the cap 1 at which it may be possible for water to be blocked from falling from the terminating end portion 9 (FIG. 1B) of the cap 1 directly into the gutter 50 is at the locations of the clips 20. Therefore, the flow of water from the cap 1 into the gutter 50 is substantially unimpeded. As stated above, many existing gutter caps connect directly to the hem edge of the gutter and have slotted openings through which water flows, which, as stated above, can be blocked by wet debris, thereby impeding the flow of water from the cap into the gutter.

Figure 3A:
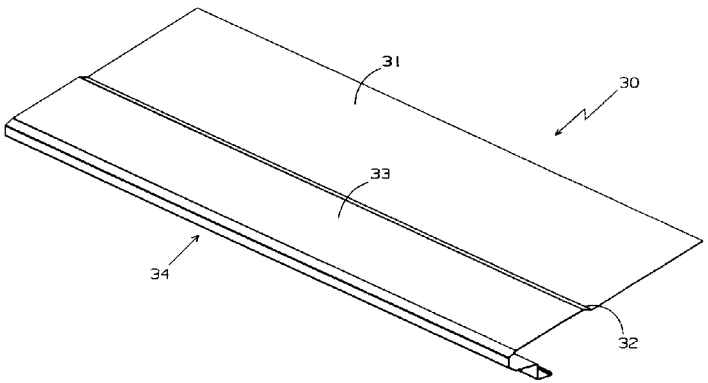
FIG. 3A is a perspective view of the gutter cap of the present invention in accordance with a second example embodiment.
Figure 3B:
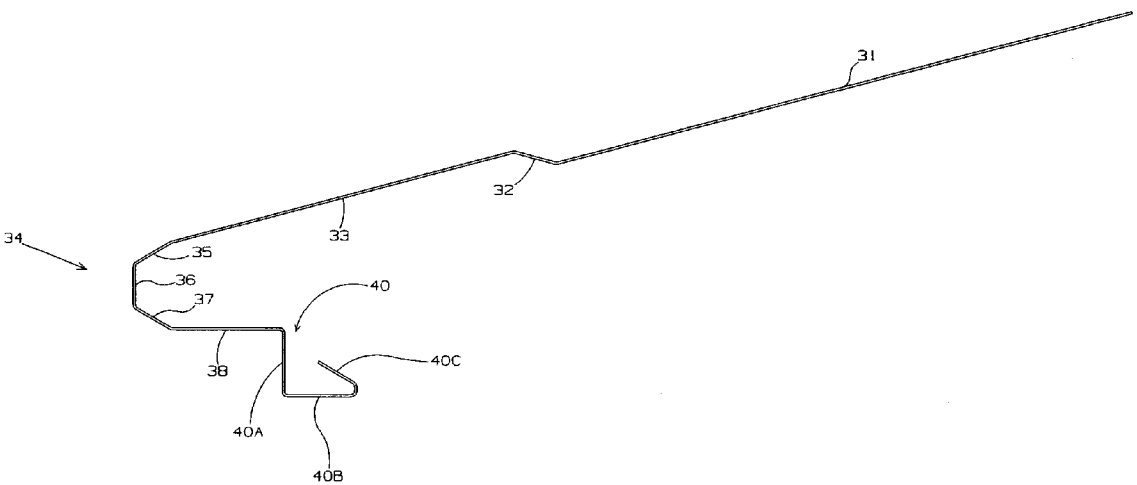
FIG. 3B is a side view of the gutter cap shown in FIG. 3A.

FIG. 3A is a perspective view of the gutter cap 30 of the present invention in accordance with a second example embodiment. FIG. 3B is a side view of the gutter cap 30 shown in FIG. 3A. The gutter cap 30 has a first portion 31, a reverse break 32 and a second portion 33. The reverse break 32 slows the water flow, flattens the water into a thin sheet-like flow, and quickly spread's the water over the second portion 33. The reverse break 32 also breaks up debris, such as soaked leaves, for example. It should be noted that some existing gutter caps have ribs formed in the caps at locations similar to the location at which the reverse break 32 of the present invention if formed, but such ribs are for the purpose of providing the cap with additional strength and do not perform the aforementioned functions of the reverse break 32.

Figure 6:
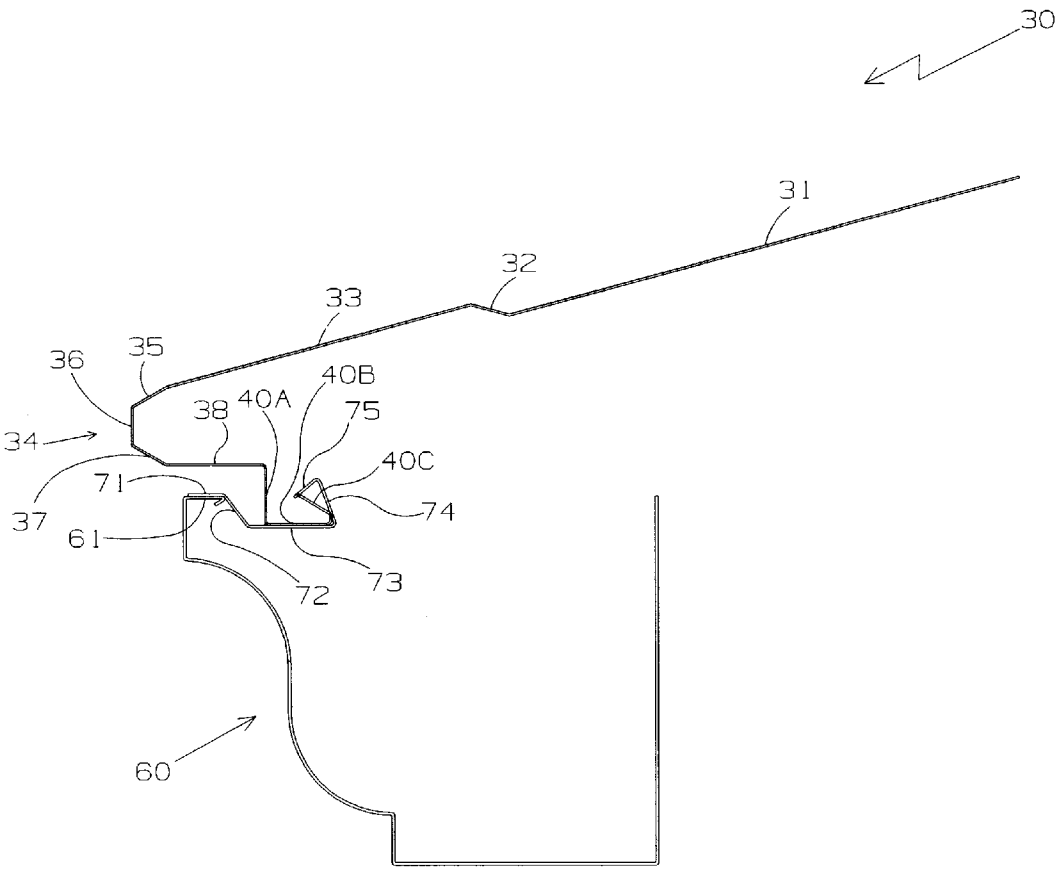
FIG. 6 is a side view of the gutter cap shown in FIGS. 3A and 3B coupled to a gutter by one or more of the clips shown in FIGS. 4A and 4B.

As shown in FIG. 3B, the second portion 33 has an end 34 that has multiple angled breaks 35, 36 and 37, and a terminating end portion 38. As stated above, in accordance with the present invention, it has been determined that providing these angled breaks 35, 36 and 37 on the end 34 causes water to adhere to the end 34 as it flows around the end 34 toward the terminating end portion 38. As stated above, in accordance with the present invention, it has been determined that the water adheres better to these angled breaks than to cap ends that are simply rounded. The terminating end portion 38 preferably is slightly angled so that it is not parallel to the ground when the cap 30 is installed. The combination of these breaks 35, 36 and 37, in conjunction with the slightly angled terminating end portion 38, results in better adherence of the water to the cap 30 as the water flows over the end 34 before falling into the trough of the gutter 60 (FIG. 6).

Figure 4A:
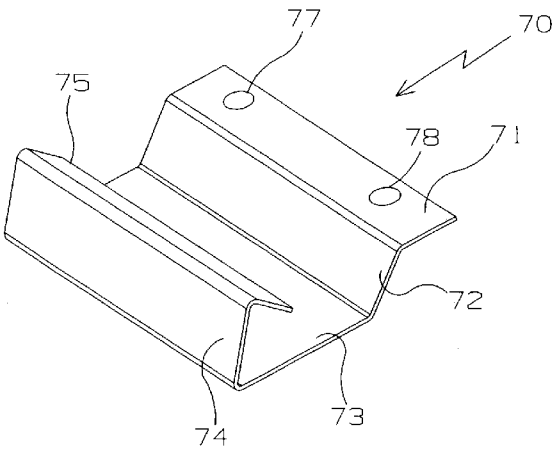
FIG. 4A is a perspective view of a clip that is configured to couple a gutter cap, such as the gutter cap shown in FIG. 3A, for example, in such a way that a limited amount of movement of the cap and the gutter relative to one another is allowed.
Figure 4B:
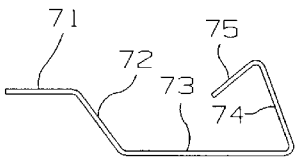
FIG. 4B is a side view of the clip shown in FIG. 4A.

With reference again to FIG. 3B, the gutter cap 30 also has a bottom hem edge 40 that is shaped differently than the U-shaped rib 10 of the gutter cap 1 shown in FIGS. 1A and 1B. This bottom hem edge 40 provides the gutter cap 30 with addition strength and resistance to downward forces on the cap 40. The hem edge 40 is also specifically configured to couple with clips having the shape shown in FIGS. 4A and 4B. FIGS. 4A and 4B are perspective and side views, respectively, of an example embodiment of the clip 70 used to attach the cap 30 to a gutter 60 (FIG. 6). FIG. 6 illustrates a side view of the gutter cap 30 attached to the hem edge 61 of a gutter 60 by one or more clips of the type shown in FIGS. 4A and 4B. The clip shown in FIGS. 4A and 4B has a particular shape that enables it to couple to the hem edge 40 (FIG. 3B) in such a way that the gutter 60 and the gutter cap 30 have some freedom of movement with respect to one another.

FIGS. 3B and 4B show particular dimensions and angles. It should be noted that although these particular dimensions and angles are preferred, the present invention is not limited to these dimensions and angles, nor is it limited to the number of breaks formed in the cap end 34. The present invention also is not limited to any particular shape for the clip used to couple the hem edge 40 of the cap 30 to the hem edge 61 of the gutter 60.

As shown in FIG. 4A, the clip 70 in accordance with this example embodiment comprises a first portion 71, a second portion 72, a third portion 73, a fourth portion 74 and a fifth portion 75. The clip 70 also has openings 77 and 78 formed therein that are designed to enable the clip 70 to be screwed to the gutter hem edge 61 (FIG. 6). As shown in FIG. 4B, the first portion 71 of the clip 70 is flat and is generally parallel to the ground when the gutter cap 30 is installed and coupled to the gutter 60, as shown in FIG. 6. The second portion 72 of the clip 70 is at a slight angle to the first portion 71. The third portion 73 is generally parallel to the first portion 71. The fourth portion 74 is at an angle to the third portion 73 that is less than 90° and is directed generally back toward the first portion 71, but at an angle to it, as shown. As indicated above, the angles and the dimensions shown are not required, but merely represent an example of one possible implementation that has been found to work well for its intended purpose.

The side view shown in FIG. 6 illustrates the manner in which the clip 70 shown in FIGS. 4A and 4B couples the gutter cap 30 to the hem edge 61 of the gutter 60. The hem edge 61 is screwed to the clip 70 by screws (not shown) or by some other attachment mechanism. Those skilled in the art will understand that a variety of attachment mechanisms are suitable for this purpose. It can be seen in FIG. 6 that the clip portions 73, 74 and 75 grip the hem edge of clip 70, which comprises portions 40A, 40B and 40C (FIG. 3B), in a particular manner. This coupling arrangement allows some slight degree of relative movement between the gutter 60 and the cap 30, which provides the aforementioned advantages. The cap 30 may be in 5 or 6-foot sections, for example, and the two clips may be located equidistance away from each other near opposite ends of the gutter cap section. Therefore, the only locations along the section length of the cap 30 at which it may be possible for water to be blocked from falling from the terminating end portion 38 (FIG. 3B) of the cap 30 directly into the gutter 60 is at the locations where the clips 70 couple the cap 30 to the gutter 60. Therefore, the flow of water from the cap 30 into the gutter 50 is substantially unimpeded. As stated above, many existing gutter caps connect directly to the hem edge of the gutter and have slotted openings through which water flows, which, as stated above, can be blocked by wet debris, thereby impeding the flow of water from the cap into the gutter.

It should be noted that the present invention has been described with reference to particular example embodiments in order to clearly demonstrate the concepts and principles of the present invention. However, the present invention is not limited to the embodiments described herein. Many modifications and changes can be made to the embodiments described herein without deviating from the scope of the present invention. For example, particular clip shapes or configurations have been described herein. These are merely example of shapes that enable the cap to be securely coupled to the gutter, while allowing some degree of relative movement between the gutter and the cap. The present invention is not limited with respect to the shape of the clip used for this purpose. A variety of clip configurations can be made that will allow these goals to be achieved. One of the primary advantages of using a clip is that the cap is not directly coupled to the hem edge of the gutter, which solves a variety of problems and overcomes disadvantages associated with the prior art.

What is claimed is:

1. A gutter cap system in combination with a gutter, the gutter cap system comprising:

a cap first portion having a first side and a second side, the first side being adapted to be secured to a roof edge of a building or house;

a second cap portion having a first border and a second border, the first border coinciding with the second side of the first cap portion and being in a plane that is at an angle to a plane of the first cap portion such that the second cap portion functions as a reverse break;

a third cap portion having a first side and a second side, the first side coinciding with the second border of the second cap portion;

a cap end formed on the second side of the third cap portion, the cap end having an upper portion that coincides with the second side of the third cap portion and a lower portion connected to the upper portion by a surface having a generally rounded shape;

a hem edge having first and second ends, the first end of the hem edge coinciding with the lower portion of the cap end; and at least a first clip on a first end thereof to location of the hem edge of the gutter cap attaches and on a second end thereof to the hem edge of the gutter, said at least a first clip securing said cap to said gutter in such a way that a relatively small amount of relative movement between said cap and said gutter is made possible.

2. The gutter cap system of claim 1, further comprising a second clip having the configuration of the first clip, the second clip first clips on the end thereof to the hem edge of the gutter cap and attaches on the second end thereof to the hem edge of the gutter.

3. The gutter cap system of claim 1, wherein said surface comprises a plurality of angled breaks that together form the generally rounded shape of said surface.

4. The gutter cap system of claim 1, wherein said cap end comprises first, second and third angled breaks that together form the generally rounded shape.

* * * * *

UNITED STATES PATENT AND TRADEMARK OFFICE

CERTIFICATE OF CORRECTION

PATENT NO. : 6,708,453 B1 
DATED : March 23, 2004
INVENTOR(S) : Hurst, Larry Timothy & Waldrop and Tony Ray It is certified that error appears in the above-identified patent and that said Letters Patent is hereby corrected as shown below:

Column 8,
Line 9, insert -- clips-- between "a first clip" and "on a first end";
Line 9, delete "location of";
Line 10, "attaches and" should be changed to -- and attaches --;
Line 17, "first clips on the end" should be changed to -- clips on the first end --.

Signed and Sealed this

Twenty-first Day of June, 2005

JON W. DUDAS
*Director of the United States Patent and Trademark Office*